United States Patent [19]

Torralba

[11] 4,112,902

[45] Sep. 12, 1978

[54] HYDRAULIC SPEED CONTROL SYSTEMS FOR INTERNAL COMBUSTION ENGINES

[75] Inventor: Jose Esteban Torralba, Zaragoza, Spain

[73] Assignee: Talleres Diesel, S.A., Zaragoza, Spain

[21] Appl. No.: 693,495

[22] Filed: Jun. 7, 1976

[30] Foreign Application Priority Data

Aug. 9, 1975 [ES] Spain ..... 440.157

[51] Int. Cl.[2] ..... F02M 39/00; F02D 1/06; F02D 1/04

[52] U.S. Cl. ..... 123/140 FG; 123/140 R

[58] Field of Search ..... 123/139 R, 140 R, 140 FG

[56] References Cited

U.S. PATENT DOCUMENTS

| | | | |
|---|---|---|---|
| 3,404,668 | 10/1968 | Eheim et al. | 123/139 R |
| 3,908,619 | 9/1975 | Bittelmeyer | 123/139 R |
| 3,927,654 | 12/1975 | Perr | 123/140 FG |
| 3,943,903 | 3/1976 | Skinner | 123/139 R |

*Primary Examiner*—Verlin R. Pendegrass
*Assistant Examiner*—Thomas H. Webb
*Attorney, Agent, or Firm*—Eyre, Mann, Lucas & Just

[57] ABSTRACT

A hydraulic speed control controls the fuel rate to an internal combustion engine. A fluid pump pumping in proportion to engine speed provides fluid to a piston in a cylinder. The position of the piston in the cylinder is attaind by a balance between the incoming fluid from the pump and the fluid flow from two outlets. Resistance to flow from one of the outlets is controlled by an accelerator valve. The position of the piston is coupled to the fuel flow controller for the engine. An economizer retards the motion of the piston toward high fuel flow rates and aids the motion of the piston toward low fuel flow rates.

5 Claims, 4 Drawing Figures

HYDRAULIC SPEED CONTROL SYSTEMS FOR INTERNAL COMBUSTION ENGINES

FIELD OF THE INVENTION

This invention concerns internal combustion engine speed control systems which work on the general principle of detecting speed fluctuations, and converting them into fluctuations in the flow of a liquid which acts on a hydraulic cylinder, thereby increasing or decreasing the speed of the engine as required, to restore nominal speed.

The present invention is a development of this principle, and takes the form of a system which operates in accordance with the general theoretical principles, but with an original and newly devised idea which ensures that during operation, the reliability and response to fluctuations in speed are both highly superior to anything that has been achieved in the past with other systems based on this same general principle.

The speed control system described here is such that engine revolutions can be extremely accurately controlled either at idle speed or tick-over, maximum rating, or at any intermediate speed between these two, thus allowing the engine to be suitably governed at all times in accordance with the requirements of its own capabilities, and those of whatever it is driving.

In addition, this invention for controlling the engine speed allows the fuel consumption to be regulated without reducing the power output in any way. Consumption can thus be kept down to a minimum, with resulting economies and the additional advantage of avoiding emissions of smoke, brought about by incomplete combustion.

DESCRIPTION OF THE DRAWINGS

Embodiments of the invention will now be more fully described by way of illustration with reference to the accompanying drawings showing a schematic arrangement of the device. This schematic arrangement is in no way to be regarded as imposing any limitations, and the device may therefore be subjected to those secondary alterations which do not effect its essential features.

Figure 1:
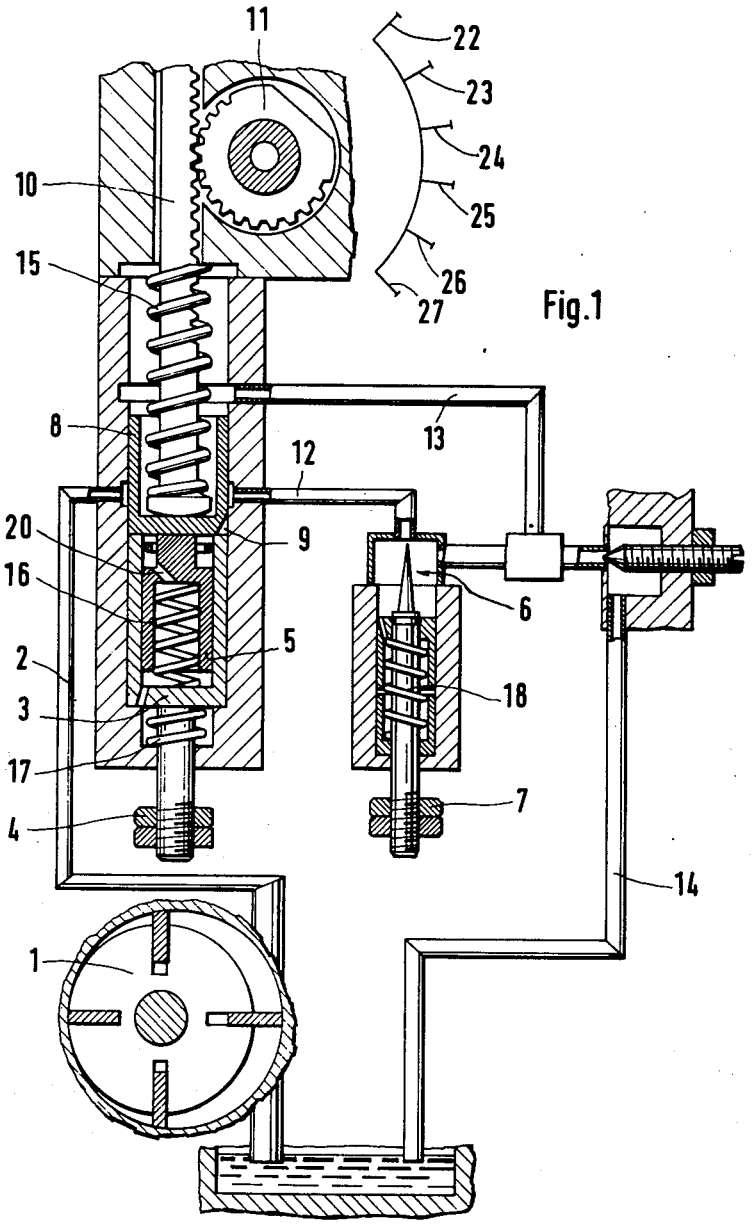
FIG. 1 shows a simplified schematic arrangement of the governor or speed control system.

The system operates by means of a hydraulic pump 1, which is coupled in synchronism with the engine or machine whose speed is to be governed. The pump delivers fluid from a reservoir at a rate which varies in proportion to the engine revolution speed, so that when this fluctuates, there is a variation in the rate of flow from the pump.

The pump is connected into inlet pipe 2 and there is a cylinder having two outlets, one being located at the bottom 12, and the other at the top 13. Plunger 8, can reciprocate in the cylinder, and the crown of the plunger is provided with a chamfer 9 which determines when a channel with a flow rate varying in accordance with the stability of plunger 8, is in line with upper outlet 13.

Rack 10 is coupled to plunger 8 and is fitted with a compression spring 15, which presses it, together with the plunger, 8 downwards. Rack 10 engages with pinion 11 which upon rotating, varies the rate of fuel being supplied to the engine to be governed.

The passage from the bottom outlet 12 is connected to the accelerator 6 in such a manner that the latter opens or closes the passage through the pipe. When the accelarator is depressed, the fluid is allowed to flow through the full speed control throttle; whereas when it is released, it causes the fluid to leave through the upper port 13. The accelerator 6 is adjustable by idle adjustment 7 and spring 18.

When the engine is about to be started, the system is at rest, with the plunger at the lower end of its travel due to pressure from spring 15 which is housed inside rack 10, which means in turn that pinion 11 is at the position for maximum rate of fuel supply 23, while the accelerator is also in the fully open position, that is, passage through bottom port 12 is open.

If, when the engine is started, the accelerator 6 is operated so as to close the outlet port 12, then due to the fluid pressure supplied by the pump 1, plunger 8 will be displaced, causing rack 10 to move, overcoming the pressure exerted by spring 15, so that pinion 11 will rotate to the zero fuel supply position 27, bringing about a drop in the pressure from the pump 1, so that plunger 8 will immediately move on a downward stroke until it finds the tick-over position 26, whereupon it is held by the pressure coming in through the adjustable passage channel 9 formed between the chamfer on the crown of the plunger and the upper outlet port.

The indications 22 to 27 inclusive are intended to correspond to the position of the pinion 11 when a center line perpendicular to the flat surface thereof is aligned with one of the indications.

Intermediate positions are determined by the amount the accelerator 6 is held open. Position 24 indicates the position where a fuel economizer begins to operate. Position 25 indicates the full speed position at no load.

Figure 2:
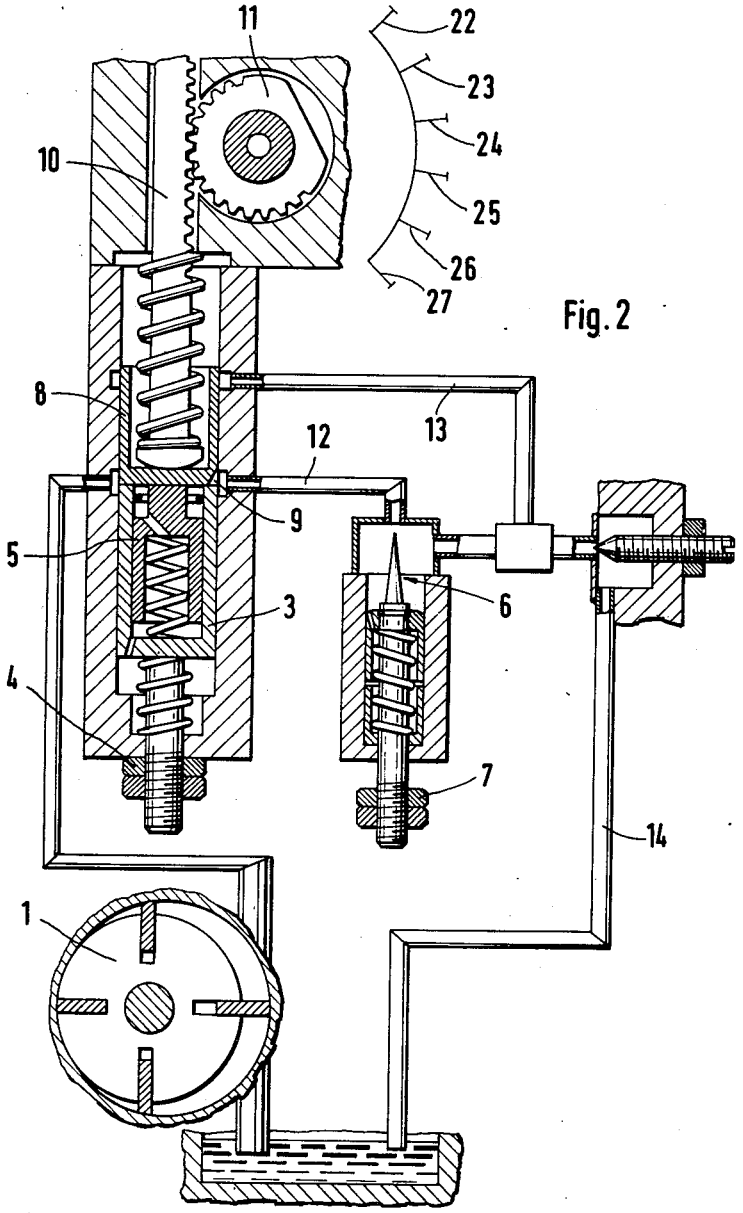
FIGS. 2 and 3 are additional schematic arrangements showing the different operating sequences of the device while the engine it is connected to is in motion, and where a fuel economizer has been fitted to act on these operating sequences.
Figure 3:
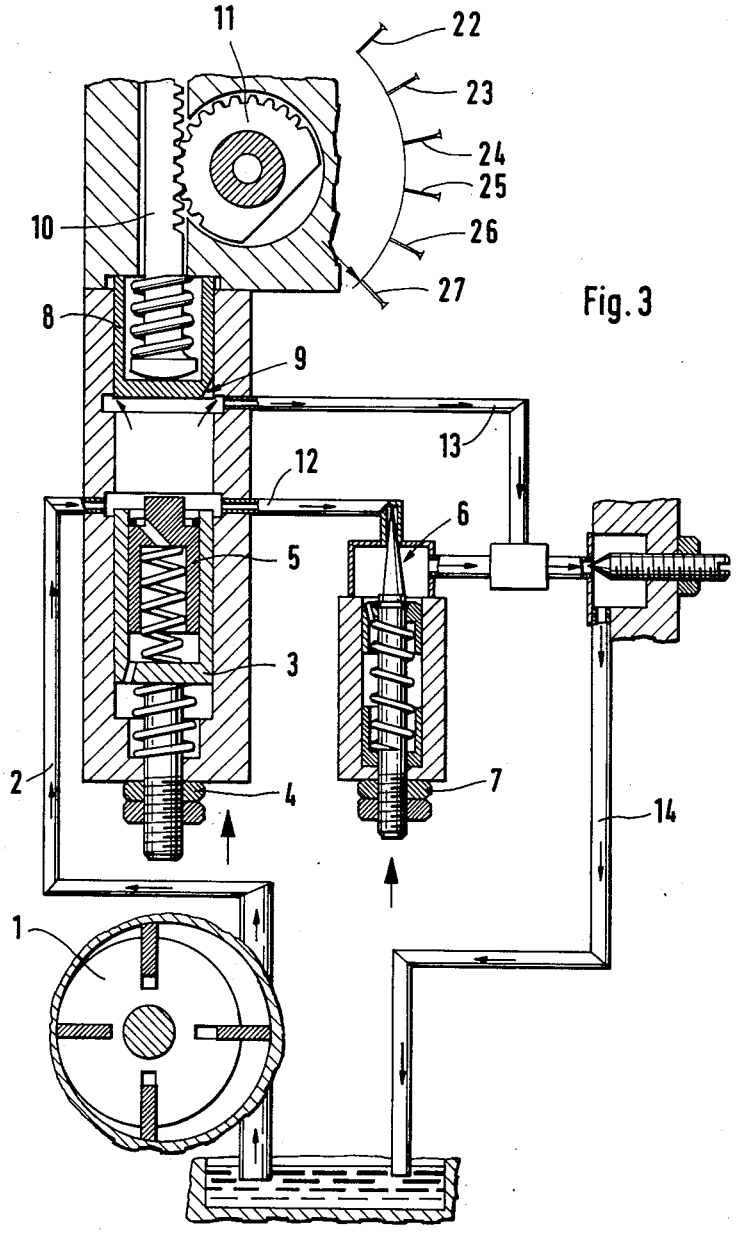

FIGS. 1 to 3 depict progressive operating sequences of the governor, and a fuel economizer is shown incorporated to the cylinder, comprising a liner 3, with stop 5 which slides inside it. A spring 16 is arranged between the stop and the bottom of the liner, and the stop is provided with a hole for the passage of fluid coming into the cylinder.

The fuel economizer comes into operation only when plunger 8 is located at a point towards the lower end of its travel, because it is prevented from doing so at other positions by the limited stroke of stop 5, this being when pinion 11 is in the full load position 23. This operation means that fuel supply requirements are lessened, due to the effect of spring 16, which is assisted by the fluid pressure coming into the cylinder from the pump, and makes stop 5 rise so that it comes up against plunger 8, and hence causes rack 10 to move back. The reverse procedure takes place when spring 15 in the rack is overcome by the pressure exerted by the lower spring housed between stop 5 and the bottom of liner 3.

An overload control 4 is also depicted in the accompanying drawings, whereby plunger 8 is allowed to begin from an even lower position when the engine is started up, because in this case pinion 11 is turned to position 22 by compressing spring 17 to provide a boost in the fuel supply.

Figure 4:
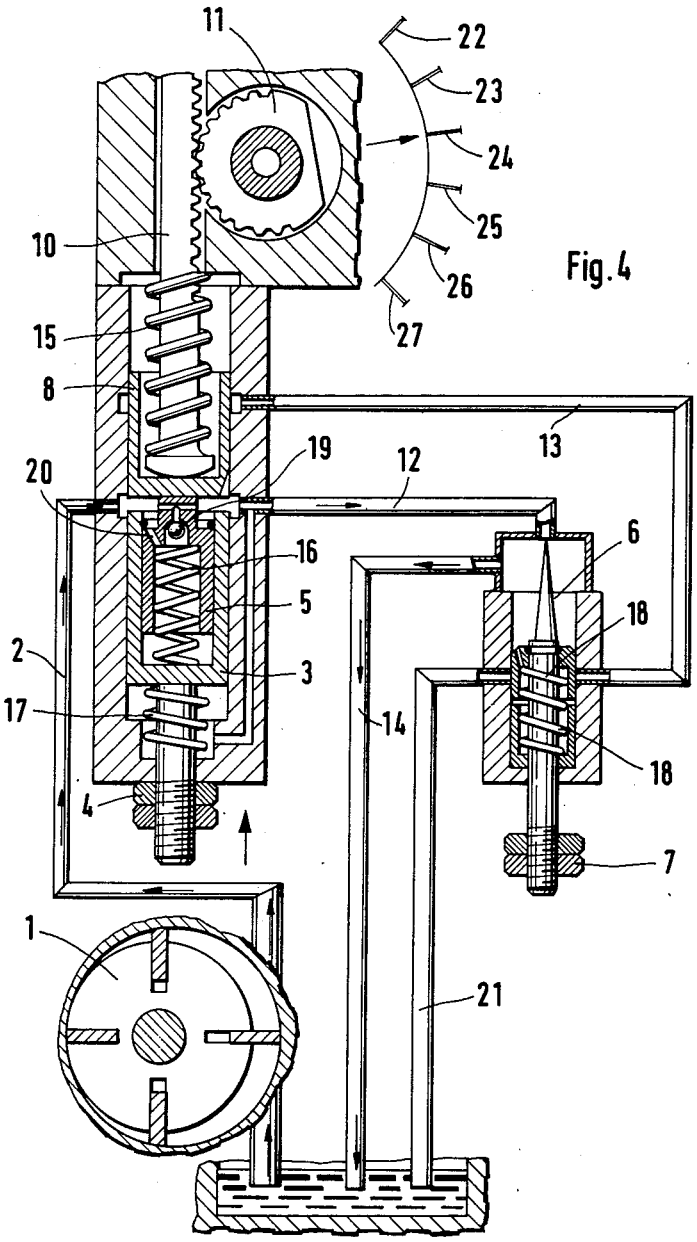
FIG. 4 shows a practical alternative embodiment of the fuel economizer acting on the governor operating sequences.

Stop 5 may be provided with a graduated flow nozzle 20, and a non-return valve 19, as depicted in FIG. 4 which shows an alternative arrangement for the fuel economizer, and for the linkages from the accelerator 6 to outlets 12 and 13.

Non-return valve 19 allows fluid to flow from the upper space in the cylinder which houses plunger 8, to the space between liner 3 and stop 5.

This arrangement enables a quick change over to be made from the full power position to another giving a scantier supply of fuel (operation of fuel economizer), while the opposite sequence can only be carried out at a much slower pace, due to the fact that while the lower space in the cylinder is fed with fluid through the graduated nozzle and the valve, with the assistance of the pressure exerted by expansion spring 16, the fluid can only leave this space through nozzle 20, and therefore does so very much more slowly. This feature can be put to good use with certain types of engine which require to be brought up to full power gradually, so as to prevent smoke in the exhaust gases brought about by unburnt fuel.

FIG. 4 as referred to, shows the lower port 12 connected to the accelerator 6 as having a direct outlet to the reservoir through pipe 14, whilst the upper port 13 is joined up to the body housing the accelerator 6, so that when this is open to let the fluid out through pipes 12 and 14, it closes or shuts off completely passage through pipc 13, and directs the flow to drain outlet 21.

What we claim is:

1. A hydraulic speed control for internal combustion engines, comprising a cylinder, a pump, whose pumping rate is proportional to that of the engine whose speed is being controlled, an inlet from said pump to said cylinder, at least two outlets in said cylinder at different levels, a plunger in said cylinder, a control linkage, a spring urging said control linkage against said plunger, means for controlling the amount of fuel supplied to the engine, said control linkage engaging said means for controlling, an accelerator means for controlling the flow from at least one outlet, said plunger being free to move against the force of said spring under the urging of said fluid, the position assumed by said plunger being determined by the fluid pressure from said pump and the position of said accelerator, a chamfer on said plunger said chamfer forming a channel having a variable passage, said variable passage being effective to stabilize said plunger in the tick-over speed position.

2. The hydraulic speed control recited in claim 1, further comprising externally adjustable control means for lowering the lowermost position of the plunger during starting of the engine.

3. The hydraulic speed control as recited in claim 2, further comprising a fuel economizer having a liner inside the cylinder, a sliding stop provided with a nozzle and disposed in said liner, a spring between the stop and the bottom of the liner; travel of the plunger away from its lowermost position being assisted by the stop and spring, with the help of the fluid pressure acting upon it; said fuel economizer retarding travel of the plunger from a position giving a low rate of fuel supply, to a high speed position.

4. The hydraulic speed control recited in claim 3, further comprising a graduated nozzle and a valve in said stop, said nozzle and valve being effective to permit fluid to flow from the cylinder into the vacant space between the liner and the stop, said valve closing when the fluid tends to flow from the space back to the cylinder whereby the change of position from full power to one requiring less fuel takes place more quickly than does the reverse procedure, due to the different speed at which the space becomes full of fluid and empties; whereby the engine is brought up to full power more slowly than might otherwise be the case if the throttle was suddenly opened, and thereby reduce smoke in the exhaust gases.

5. A hydraulic speed control system for an internal combustion engines comprising:

(a) a fluid pump for coupling in synchronism with the engine whose speed is to be governed;
(b) a cylinder;
(c) at least one outlet to said cylinder from said pump;
(d) one bottom outlet at the bottom of said cylinder and a top outlet at the top of said cylinder;
(e) accelerator means for controlling the flow of fluid from the bottom outlet;
(f) a plunger slideably arranged in the interior of the cylinder;
(g) one of the ends of said plunger being beveled, said beveled end being effective to control the opening of the top cylinder outlet;
(h) a pinion that by its rotation determines the engine's fuel feeding rate; and
(i) means for transmitting the plunger movement to the pinion.

* * * * *